US007908796B2

(12) United States Patent
Hancock

(10) Patent No.: US 7,908,796 B2
(45) Date of Patent: Mar. 22, 2011

(54) FENESTRATION ASSEMBLY

(75) Inventor: Michael John Hancock, Tauranga (NZ)

(73) Assignee: HPJ Holdings Limited (NZ)

( * ) Notice: Subject to any disclaimer, the term of this patent is extended or adjusted under 35 U.S.C. 154(b) by 0 days.

(21) Appl. No.: 11/914,249

(22) PCT Filed: May 12, 2006

(86) PCT No.: PCT/NZ2006/000108

§ 371 (c)(1),
(2), (4) Date: Nov. 13, 2007

(87) PCT Pub. No.: WO2006/121355

PCT Pub. Date: Nov. 16, 2006

(65) Prior Publication Data

US 2008/0202033 A1 Aug. 28, 2008

(30) Foreign Application Priority Data

May 13, 2005 (NZ) ..... 540065

(51) Int. Cl.
*E05F 3/00* (2006.01)

(52) U.S. Cl. ..... 49/447

(58) Field of Classification Search ..... 49/404, 49/445–447, 458, 459
See application file for complete search history.

(56) References Cited

U.S. PATENT DOCUMENTS

| | | | | |
|---|---|---|---|---|
| 450,081 | A * | 4/1891 | Mesker et al. | 49/459 |
| 450,082 | A * | 4/1891 | Mesker et al. | 49/459 |
| 451,874 | A * | 5/1891 | Mesker et al. | 49/459 |
| 451,877 | A * | 5/1891 | Mesker et al. | 49/459 |
| 642,369 | A * | 1/1900 | Reynolds | 49/447 |
| 1,678,444 | A * | 7/1928 | Roedl | 49/445 |
| 2,135,680 | A * | 11/1938 | Sharp | 49/459 |
| 2,791,796 | A * | 5/1957 | Haas | 16/202 |
| 2,821,753 | A * | 2/1958 | Sitterly | 49/445 |
| 3,447,266 | A * | 6/1969 | Nachtsheim | 49/458 |
| 3,820,193 | A * | 6/1974 | Foster | 16/197 |
| 6,286,263 | B1 | 9/2001 | Burrill | |
| 7,047,693 | B2 * | 5/2006 | Lundahl | 49/447 |
| 2002/0162286 | A1 | 11/2002 | Heissenberg | |

FOREIGN PATENT DOCUMENTS

| | | |
|---|---|---|
| EP | 0261907 A2 | 3/1988 |
| GB | 2329925 A | 4/1999 |

* cited by examiner

*Primary Examiner* — Katherine Mitchell
*Assistant Examiner* — David E Allred
(74) *Attorney, Agent, or Firm* — Brooks Kushman P.C.

(57) ABSTRACT

A fenestration assembly which includes; an exterior panel section configured to receive and locate an exterior panel, an interior panel section configured to receive an interior panel, wherein the interior panel section includes at least one linkage system configured to connect to an interior panel to be received by the interior panel section, this linkage system being configured to cover at least a portion of a track formed within said interior panel section. The fenestration assembly may in other instances include an interior panel section where a portion of this interior panel section is associated with a cladding material and where a portion of the interior surface of an exterior panel received by the exterior panel section is covered by cladding material associated with the interior panel section.

14 Claims, 6 Drawing Sheets

FENESTRATION ASSEMBLY

TECHNICAL FIELD

This invention relates to an improved fenestration system.

Preferably the present invention may be employed to provide a composite material fenestration system with an improved thermal performance and aesthetic appeal to consumers.

Reference throughout this specification will also be made to the fenestration system provided employing aluminium in combination with either wood or polyvinyl chloride (μPVC) in its construction, but those skilled in the art should appreciate that potentially a combination of other materials or any single material may also be used to provide the present invention if preferred.

BACKGROUND ART

Fenestration is used to frame and mount glazing in the windows and entrance ways of buildings.

Traditionally, wooden fenestration has been employed for such purposes. Wooden fenestration functions effectively to provide both an aesthetically attractive window or doorway and also performs well as a thermal insulator.

Thermal insulation is important in fenestration to ensure that the temperature at the exterior of a building is not transferred into its interior.

The use of thermally insulative materials such as wood ensures that heat loss from the interior of a building is minimised in cold climates, and the interior of a building is not heated in warm climates.

It is also important to provide thermally insulating materials in fenestration to ensure moisture condensate is not formed on the interior surfaces of the fenestration.

If the interior faces of fenestration are cooler than the ambient temperature inside a building, this can cause moisture to condense and potentially damage adjacent components in the interior of a building.

However, wooden fenestration is not directly suited to mass production techniques and applications. Wood generally requires a high level of skill from a manufacturing labourer to section the required fenestration shapes and also to install the resulting fenestration in a building. Furthermore, the wood used, although relatively attractive in its final finished section, is also a relatively costly building material.

Aluminium fenestration has been developed as an alternative to wooden fenestration. Aluminium can be extruded into relatively complex profiles (or sections) in large volumes with relatively low labour costs.

Furthermore, the costs of the aluminium material are lower than that of wood, thereby resulting in a comparatively low cost fenestration product.

However, there are some existing problems present with the use of aluminium fenestration.

Aluminium fenestration does not have the same level of aesthetic appeal to some consumers, who have a preference for the more natural or warmer appearance of wood. Regulations regarding preservation of heritage buildings may also require that the aesthetics of wood are used in the interior of a building.

Aluminium also does not function effectively as a thermal insulator, which results in heat losses to the exterior of a building in cold climates and the reverse effect in hot climates.

Furthermore, condensate will also generally form on the exposed interior surfaces of the fenestration which can cause water or moisture damage to the surrounds of the window or doorway involved.

Some existing attempts have been developed to produce hybrid (or composite) fenestration systems which harness both the thermal and aesthetic advantages of wood and the manufacturing and cost advantages of aluminium fenestration. An example of composite fenestration is Fletcher Aluminium ALTI® system marketed in New Zealand as also detailed at the internet address, www.altinz.co.nz.

The ALTI® system is implemented as sliding panel fenestration. Sliding panel fenestration normally employs a fixed static panel and a sliding panel adjacent to the fixed panel. The sliding panel can be moved laterally across a track laid in the fenestration to open and close a window or doorway formed in a structure.

However, the ALTI® fenestration system also has a number of problems in its implementation.

A significant amount of wood is still required to clad the interior surfaces of the fenestration. In such instances the exposed interior face of the sliding panel provided is preferably clad with wood.

This again requires a reasonably skilled labour force to produce the wooden cladding required and also once again results in increased labour manufacturing cost for the resulting composite fenestration.

Furthermore, the amount of wood used again inflates the materials cost of the resulting fenestration.

Another type of fenestration system commonly used is the double hung window or 'sash' window. These types of windows incorporate two sliding panels or panes located with a paired set of tracks with one panel vertical disposed above the other when the window is closed. In the closed configuration the upper panel is disposed within the upper regions of a track on the exterior side of the fenestration facing outwards towards the exterior of a structure. The remaining panel is located within the lower portions of a track on the interior side of the fenestration to face towards the interior side of the structure involved. Some overlap is also provided between the lower regions of the upper "external" panel and the upper regions of the "internal" panel to prevent water leaking into the structure from the exterior side.

These double hung window fenestration assemblies allow both the exterior and interior panels to move within a set of vertically orientated tracks. However, as can be appreciated by those skilled in the art, a large section of the interior panel's track will be exposed to the interior of a structure when the panel is shut. This is aesthetically displeasing.

This aspect of the double hung window design has generally led to the implementation of this type of fenestration in thermally insulative materials. The thermally insulative properties of these materials are harnessed to prevent heat transfers across the fenestration assembly and in particular through the exposed surfaces to the interior of the building. For these reasons aluminium is generally considered an unsuitable material for double hung fenestration systems.

An improved fenestration system which addressed any or all of the above problems would be of advantage. Specifically a fenestration system which could be produced at relatively low cost and which had improved thermal efficiencies over the prior art would be an advantage. A fenestration system which has improved aesthetic appeal and which covered an interior track which may otherwise be exposed would also be of an advantage. Further an improved fenestration system or assembly which covered the track of an interior panel when the panel is in a closed position would also be of advantage.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents section part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a fenestration assembly which includes;

an exterior panel section adapted to receive and locate an exterior panel, an interior panel section adapted to receive and locate an interior panel, wherein at least a portion of said interior panel section is associated with a cladding material, wherein at least a portion of the interior surface of an exterior panel received by the exterior panel section is covered by cladding material associated with the interior panel section.

According to a further aspect of the present invention there is provided a fenestration assembly which includes;

an exterior panel section adapted to receive and locate an exterior panel, an interior panel section adapted to receive and locate an interior panel, wherein at least a portion of said interior panel section is associated with a cladding material, wherein at least a portion of the interior surface of an interior panel received by the interior panel section is covered by cladding material associated with the interior panel section.

According to another aspect of the present invention, there is provided a fenestration assembly panel which includes;

an exterior panel section adapted to receive and locate an exterior panel, an interior panel section adapted to receive and locate an interior panel, wherein at least a portion of said interior panel section is covered by a cladding material, wherein at least a portion of the interior surface of an exterior panel received by the exterior panel section is covered by the cladding material applied to the interior panel section.

According to yet another aspect of the present invention there is provided a fenestration assembly substantially as described above wherein the interior surfaces of at least the edges of a frame integrated into an exterior panel are covered by the cladding material associated with an interior panel section.

According to a further aspect of the present invention there is provided a fenestration assembly which includes;

an exterior panel section adapted to receive and locate an exterior panel, and an interior panel section adapted to receive and locate an interior panel, and at least one linkage system adapted to connect to an interior panel to be received by the interior panel section, said at least one linkage system being adapted to cover at least a portion of a track formed within said interior panel section.

According to yet another aspect of the present invention there is provided a fenestration assembly substantially as described above wherein a linkage system includes, a biasing means adapted to resist the force of gravity acting on a panel when said panel is moved along an interior track provided within said interior panel section, and a cover belt adapted to connect a panel to the biasing means and to transfer a biasing force applied by the biasing means to the panel, wherein said cover belt is adapted to cover at least a portion of a track formed within the interior panel section.

The present invention is adapted to provide an improved fenestration assembly which preferably can provide an improved aesthetic appeal to consumers. Furthermore, the fenestration assembly provided may also exhibit improved thermal insulation characteristics when compared with other existing prior art sections of fenestration.

The fenestration assembly may be used to frame glazing or other types of panels within the walls, window apertures or doors of a structure or building. Preferably the present invention may be used with panels which can receive or locate at least one sheet of glass.

In preferred embodiments of the present invention the fenestration assembly may be used to implement a double hung window assembly. Double hung window assemblies are well known in the art and generally used to frame glazing panels and allow these panels to slide up and down between open and closed configurations.

Alternatively, the fenestration assembly may be used in a 'single hung window'. In this embodiment, one panel of a two panel window may be fixed, and the other free to move between open and closed configurations.

Reference in general will also be made throughout the specification to the use of the present invention with double hung window assemblies. However, those skilled in the art should appreciate other types of movable panel based fenestration systems may also be implemented in conjunction with the present invention and reference to the above only throughout the specification should in no way been seen as limiting.

Throughout the present specification the term "exterior panel section" should be understood to mean an assembly within the fenestration assembly that locates, or can be adapted to receive, an exterior panel.

Throughout the present specification the term "exterior panel" should be understood to mean a substantially sheet-like material or assembly that is securely located, framed, or able to be received, into a desired position within, or by, the exterior panel section of the present invention.

Furthermore, an exterior panel should be considered to encompass an exterior panel frame if required. Such a frame can then provide support to the sheet-like material employed within the panel and also act as an interface element or mounting system for the panel.

For example, in a preferred embodiment of the present invention an exterior panel may be formed from a double glazed assembly constructed of glass sheets or any other suitable material used to provide the bulk of material employed to section a window of a building. In such instances a double glazed panel may include a frame surrounding the edges of the glazing sheets as well as any spacer components or elements fitted between the glazing sheets to space same apart.

Reference throughout this specification will now be made to an exterior panel being formed from a glazing panel. However this should not be seen to be a limitation on the present invention in any way as those skilled in the art should appreciate that other types of material may also be used within the present invention.

The term "interior panel section" should be understood to mean an assembly within the fenestration assembly that locates, or can be adapted to receive, an interior panel and which is constructed to allow the interior panel to move within the boundaries of the interior panel section.

The term "interior panel" should be understood to mean a substantially sheet-like material or assembly that is located in, or able to be received by, the interior panel section of the present invention and which is able to be moved between a closed position and fully open position which are within the boundaries of the interior panel section. Furthermore, the term "interior panel" should be considered to encompass framing elements used to surround, protect or otherwise mount the entire interior panel assembly, and may also incorporate any spacer elements used to distance two or more sheets of which section the bulk of the volume or surface area of the panel.

The interior panel section receives an interior panel but yet still allows the interior panel to be moved relative to the installed overall fenestration assembly. Such interior panels may therefore facilitate the provision of window openings within the finished/installed fenestration assembly.

In preferred embodiments of the present invention the interior panel installed or received into the interior panel section may be constructed from a glazing panel or glazing sheet assembly. Such glazed interior panels are well known in fenestration applications and allow interior window assemblies to be constructed where the bulk of the window is formed from glass sheet materials. Furthermore, such glazed panels can also employ double glazing techniques to provide a significant degree of thermal insulation across the glazed portion of the window or doorway provided.

Reference throughout this specification will also be made to an interior panel being implemented as a double glazed panel. Such a panel may include an interior panel frame which surrounds the parameter edges of the glazing, where such framing also includes glazing spacers located between the sheets of the double glazing panel to space the same apart from one another.

However, those skilled in the art should appreciate that other types of sheet like materials or assemblies may be employed to provide such panels, and reference to the above only throughout the specification should in no way be seen as limiting.

In a preferred embodiment, the interior cladding material, the interior panel section, and the exterior panel section, may be formed from one material, forming an integral fenestration panel assembly. Preferably, this panel section assembly may be formed from a material with cladding properties. This material may be thermally insulative, or may be aesthetically pleasing, or both. Alternatively, the panel sections may be formed by another material, and a cladding material may be applied onto the panel section assembly.

The term 'cladding material' should be understood to mean any material with cladding properties. A cladding material may be any material which can be used to form a fenestration assembly, preferably for use within buildings. A cladding material may be a material such as wood, fibreglass, or polyvinylchloride (PVC). The present invention may be formed from a 'cladding material' or the material may be applied to the interior and/or exterior panel sections separately. Cladding associated with a panel may form the frame of a panel, may be applied to the panel or may be associated with any part of the fenestration assembly that receives or locates the panel it is associated with.

Reference throughout the specification will be made to the fenestration assembly being formed in separate sections, or formed and clad with different materials. However, those skilled in the art should realise that the fenestration panel assembly can be formed from one material and reference to the above only throughout the specification should in no way be seen as limiting.

In a further preferred embodiment both the interior panel and the exterior panel may be formed from essentially the same components. These panels may be interchanged with one another in such embodiments to simplify and preferably reduce the cost of manufacturing the resulting fenestration and associated window panels.

Reference through out this specification will also be made to the interior and exterior panels being formed from the same components, but those skilled in the art should appreciate that other configurations of these components are also envisioned.

Preferably the interior panel, once received by the interior panel form, may define or include an interior surface and an exterior surface.

The interior surface of the interior panel will be located or positioned so as to face the interior of the structure within which the fenestration assembly is installed.

Conversely, the exterior surface of the interior panel will be formed by the opposite surface to the interior surface and will face out into the environment that is exterior to the structure in which the fenestration assembly is employed.

The interior panel section defined in the fenestration assembly can include a number of exposed surfaces which, when the fenestration is installed, will face into the interior of the building or structure involved.

Normally such exposed surfaces would provide a heat transfer interface between the exterior and interior of the structure. This may be detrimental as heat from a room may escape through the fenestration assembly.

In preferred embodiments of the present invention at least a portion of the exposed surfaces of the interior panel section may be associated with a thermally insulative cladding material.

Associating these surfaces with a thermal insulator cladding material provides a heat resistant barrier between the interior of a building and its exterior, thereby reducing the channel for heat transfer through the interior panel section of the fenestration assembly.

In a further preferred embodiment the exposed surfaces of the interior panel section which are clad may be the surfaces which face directly into the interior of the structure within which the fenestration is installed. These are surfaces which are readily visible to the observer and on which condensate can collect and potentially drip into the interior of the structure. Furthermore, these exposed surfaces which face into the interior of the structure can also be readily clad with additional thermally insulated material to reduce a heat transfer interface being provided.

In a preferred embodiment the exposed surfaces of the interior panel section may be formed or clad with a wooden material. In other embodiments, the fenestration assembly may be formed by fibreglass.

Those skilled in the art should appreciate that different types of cladding material may also be employed. In alternative embodiments, the fenestration assembly may be formed from, or separately clad with, a material that is not thermally insulative. This material may be provided for its aesthetic properties only. In this embodiment, the term 'cladding material' may be seen to refer to a material which may partially cover at least a portion of the interior surface of an exterior panel.

In other embodiments plastic materials such as PVC (polyvinyl chloride) may be used as cladding material, which also need not necessarily be applied to only the faces of the interior panel section which are orientated to face the interior of a structure within which the fenestration assembly is to be installed. For example, and as discussed below in some alternative embodiments, further cladding may also be applied over or within a track within an interior panel section if required.

Wood provides an effective thermal insulator to prevent heat transfer through the materials used to construct the fenestration assembly. Furthermore, wooden surfaces are potentially more aesthetically pleasing to consumers in a number of instances.

Preferably the bulk of material used to provide the fenestration assembly (and in particular the exterior and interior panel sections) may be aluminium.

Aluminium is a relatively inexpensive material which can readily be extruded into a number of complex and useful sections, thereby making it very useful for fenestration systems.

Preferably the fenestration assembly may employ the aluminium sections in combination with thermally insulative cladding material to provide a composite fenestration system with an improved aesthetic appeal and thermal insulative performance.

In a preferred embodiment of the present invention the configuration or arrangement of the interior panel section and its associated cladding material may be constructed so that the cladding material involved also covers the perimeter (or edges) of the interior surface of the exterior or interior panel.

In such instances, the panel involved may be framed with aluminium material or other sections of relatively low cost materials which can be easily manufactured and installed, but which may have a high degree of thermal conductivity. Such framing materials may be used to locate the glazing sheets provided and subsequently act as an interface with the exterior panel section.

Furthermore, the interior panel section cladding can also conceal, cover or effectively hide from view the interior portions of the interior or exterior panel section. Hiding these components from view can provide visual and potentially pleasing results in the construction of the finalised installed fenestration assembly.

In a further embodiment cladding material applied to the interior panel section may also be adapted to conceal, cover or effectively hide from view the interior or exterior panel frame.

In a further embodiment the interior panel section may also include or define an interior track along which the interior panel is adapted to move. Preferably the interior track may extend substantially along the height of the fenestration assembly so as to allow the interior panel to be moved up and down along the height of the fenestration assembly if required.

In a further preferred embodiment the interior track defined in the interior panel section may allow the interior panel to be located in either an open configuration, or a closed configuration, or in a position or location between these opposed configurations.

For example, when placed in an open configuration, the interior panel will section an aperture within the fenestration assembly such as an opened window and will be aligned substantially parallel with the exterior panel so that the interior panel covers (or is covered by) the exterior panel.

Conversely, when placed in its closed configuration the interior panel may close the aperture it would normally section when open and be placed juxtaposed or orientated juxtaposed and slightly offset, across the height of the fenestration assembly with respect to the exterior panel.

In a further preferred embodiment the exterior panel section may also include or define a track along which the exterior panel is adapted to move. Such an exterior track formed or defined within the exterior panel section may extend substantially along the height of the fenestration assembly so as to allow the exterior panel to be moved up and down within the fenestration when required.

In such embodiments the present invention may therefore provide a double hung window assembly, which allows movement of both the interior and exterior panels up or down as required by a user. For instance such a window may be opened through the exterior panel being dropped to the level of the interior panel, leaving an aperture in the upper regions of the fenestration assembly. Conversely the same window may be opened by raising the interior panel to the level of the exterior panel, providing an aperture in the lower portions of the fenestration assembly.

In a further preferred embodiment the tracks provided in both interior panel section and the exterior panel section may be essentially equivalent to one another. By providing the same section or configuration of these tracks, this in turn allows the same types of components to be employed as both the interior and exterior panels to run along these tracks.

In a preferred embodiment at least the interior panel section may include at least one linkage system linked to the panel which the section receives. In a further preferred embodiment a pair of linkage systems may be provided for each of both the external and internal panel sections at either side of each section.

Preferably a linkage system as discussed through out this specification maybe defined as the component configured to apply a biasing force to a panel to resist the force of gravity acting on the panel. The use of four linkage systems configured in pairs at the sides of each section allows each panel to be moved, and held in any position through the linkage system resisting the force of gravity pulling the panel downwards.

Reference throughout this specification will also be made to a pair of linkage systems being provided for each panel to be located in the fenestration involved. However, those skilled in the art should appreciate that linkage systems may only be provided in association with an interior panel section in some embodiments if required.

Preferably a linkage system provided in accordance with the present invention may include a biasing means adapted to resist the force of gravity acting on a panel when such a panel is raised along the track provided within a panel section.

In a preferred embodiment a linkage system may include a biasing means formed by an extension spring connected to a corner, side or edge of a panel by way of a cover belt, and preferably a pulley over which the cover belt is to run. This arrangement of a 'spring' linkage system may be configured so as to extend the spring when the panel is lowered, thereby resulting in an upward biasing force being applied. When the panel is raised the spring will assist its motion and act to balance off the force of gravity acting on the panel, and therefore holding the panel in the position in which it is left by a user.

Reference throughout this specification will also be made to a linkage system provided within a panel section being configured as a linkage system with an extension spring provided as the biasing means. However, those skilled in the art should appreciate that other types of linkage system and in particular biasing means may be employed in conjunction with the present invention, and reference to the above only throughout this specification should in no way be seen as limiting.

For example, in one alternative embodiment, a linkage system's biasing means may be formed by an elastic resilient element, such as an elastic belt or strap, which may stretch and resist the force of gravity acting on a panel. In such an embodiment this elastic belt may provide both a biasing means and a cover belt. Alternatively, a compression spring may be provided as a biasing means or any other section or configuration of components may be loaded or energised by the weight of a panel as gravity acts on same.

Those skilled in the art should also appreciate that when the interior panel is lowered (and placed in a closed configuration) the upper regions of the interior track which this panel is to move in will also form an exposed surface of the interior panel section.

This is an issue when the thermal transfer characteristics of the resulting fenestration are considered, in that when the resulting window is closed users will generally want to retain as much heat as possible within the interior of the structure, and these exposed track surfaces will represent a heat loss interface.

Furthermore in some alternative embodiments additional exposed surfaces of an interior panel section, not necessarily facing directly into the interior of a structure, may also be directly clad with insulative material. For example, in one alternative embodiment the exposed upper surfaces of an interior track defined within the interior panel section may be clad with insulative material in addition to the thermal barrier provided by a linkage system or portions thereof in accordance with a preferred embodiment.

Exposure of the interior track to the interior of a structure can also cause aesthetic problems, as the visible track can ruin the line of the window.

In a preferred embodiment at least one linkage system associated with an interior panel section may be adapted to cover at least a portion of an interior track formed within such an interior panel section. In a further preferred embodiment a linkage system or linkage systems provided within the interior panel may be adapted to cover the upper portions or regions of such an interior track. In such instances the exposed surfaces of the interior track visible when the interior panel is closed are covered and preferably insulated by a component or components of the linkage system.

In a preferred embodiment a linkage system may include a cover belt which is adapted to connect the biasing means to a panel. Such a cover belt may be used to transfer a force applied by the biasing means to the panel. In a further preferred embodiment at least a portion of such a cover belt may be configured in use to cover at least a portion of an interior track provided within an interior panel section.

Preferably the cover belt provided is adapted to cover the upper regions of an interior track which are normally exposed when the panel is closed and located in the lower regions of such an interior track. In such embodiments the section, size and dimensions of the covering portions of the cover belt may be adapted to fit within and seal the sides of a cavity formed in the jamb of the interior panel section.

This configuration of the cover belt will therefore shield the upper regions of an interior track from view when the interior panel is closed and also contribute towards the thermal insulation of such a track. Those skilled in the art should appreciate that when the window or interior panel is closed the body of the panel will act to cover from view and insulate the exposed surfaces of the lower portion of such an interior track.

Reference by this specification will also be made to a linkage system used in conjunction with the interior panel section including a cover belt which has a portion adapted to cover the upper regions of an interior track formed within the interior panel section.

In a preferred embodiment a cover belt may be connected to a biasing means by way of a connection cord. Such a connection cord may be connected to a spring as provided in accordance with the preferred embodiment, whereas the opposite end of the cover belt may be connected to the panel involved. The cover belt may also be run over a pulley arranged so that it will cover the exposed surfaces of the upper regions of the track provided.

The linkage system provided can be used in any fenestration assembly which may or may not be associated with a cladding material substantially as described above. Similarly, the fenestration assembly provided may be clad to cover at least a portion of an exterior or interior panel, but may not include a linkage system in other instances. However, preferably the fenestration assembly provided includes a linkage system that is provided in conjunction with a cladding material, providing improved thermally insulative properties, and aesthetic appeal.

Those skilled in the art should be aware of the advantage of a cladding material, which provides the fenestration assembly with improved thermal properties and improved aesthetic properties.

Furthermore, it is also apparent that the linkage system, including a cover belt to cover the interior track from view, has aesthetic advantages and may also provide some thermal insulation.

It should be apparent to those skilled in the art that the two aspects of the present invention can be used independent of one another. However in a preferred embodiment, they are provided together. Use of the cladding associated with the assembly as well as a cover belt allows the interior track of the assembly to be covered and the cladding and cover belt combination provide a substantially unbroken line to the eye of a user.

From the aforegoing description it can clearly be seen that the present invention has many advantages over the prior art systems, both functionally and aesthetically.

One significant advantage of the present invention is that when closed in preferred embodiments the present invention appears to implement a two-panel wooden window. This is not only aesthetically pleasing to most people but more importantly, it can have a much lower thermal dissipation rate than if the aluminium framework were exposed.

Another advantage is that due to the panel frames being hidden by the cladding, the frame involved does not need to be separately clad. This lowers the cost of manufacture and also reduces the amount of cladding visible when viewing the fenestration assembly.

The present invention may also be adapted to provide the thermal and aesthetic advantages discussed above with either double hung or single hung windows, or any combination of sliding panels together in the same fenestration assembly.

Another advantage is that due to a panel being covered by the interior panel section cladding, this component does not need to be separately clad. This lowers the cost of manufacture and also reduces the amount of cladding visible when viewing the fenestration assembly required.

In addition the provision of a linkage system or linkage systems within an interior panel section which cover the exposed surfaces of the sections track may also provide some significant advantages over prior art. Preferably through the use of a cover belt integrated within a linkage system the exposed surfaces of these upper track regions may be covered and therefore insulated and hidden from view when the resulting window is closed. This results in a thermally efficient fenestration assembly and also adds to the aesthetic appeal of the resulting fenestration.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
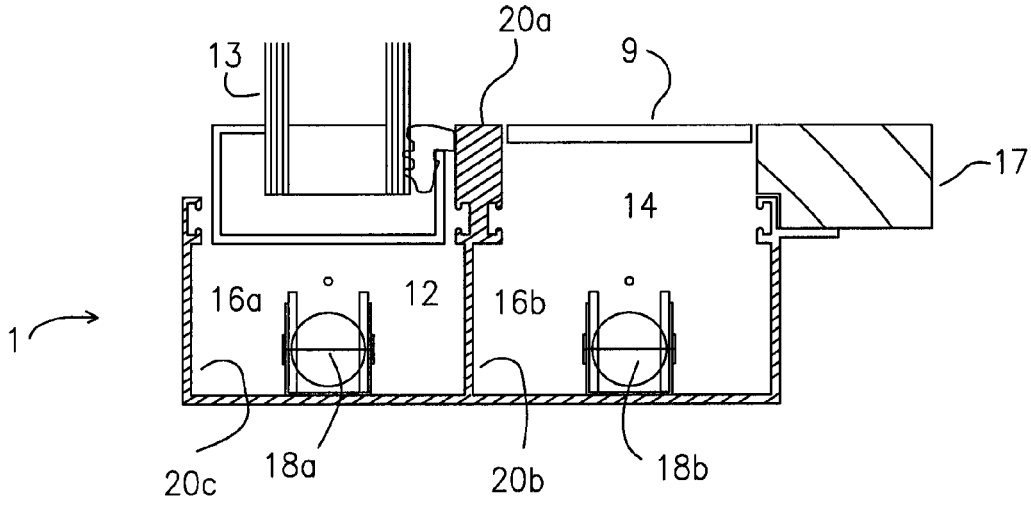
FIG. 1 shows a cross section plan view of a fenestration assembly configured in accordance with a preferred embodiment of the present invention.

FIG. 1 shows a cross section plan view of a portion of the present invention configured in accordance with a preferred embodiment.

FIG. 1 shows a fenestration assembly which implements a double hung window in accordance with a preferred embodiment. The fenestration assembly (1) includes an exterior panel section (12) which receives and locates an exterior panel (13), an interior panel section (14) which receives and locates an interior panel (not shown). The interior panel section (14) includes a linkage system (18*b*) connecting the interior panel to the interior panel section (4). This linkage system (18*b*) includes a cover belt (9) which covers the interior track (16*b*) when the interior panel is in the lower half of the interior track.

In this embodiment, interior cladding (17) the interior panel section (14) and the exterior panel section (12) are formed by a single material with cladding properties. This cladding material is preferably a thermally insulative material such as wood. In such embodiments, the cladding material which preferably covers a portion of the interior surface of the exterior panel (13) and a portion of the interior panel section (14) may be formed from materials such as fibreglass. Fibreglass can be easily altered to represent the look of a more traditional material such as wood, but can be easier to manufacture when working with large numbers of assemblies. However, in alternative embodiments, this cladding material may not be thermally insulative, it may be provided for aesthetic purposes only.

Preferably the fenestration assembly includes cladding material as well as a cover belt. However, it may consist of the cover belt only or the covered panel only in other embodiments.

Figure 2:
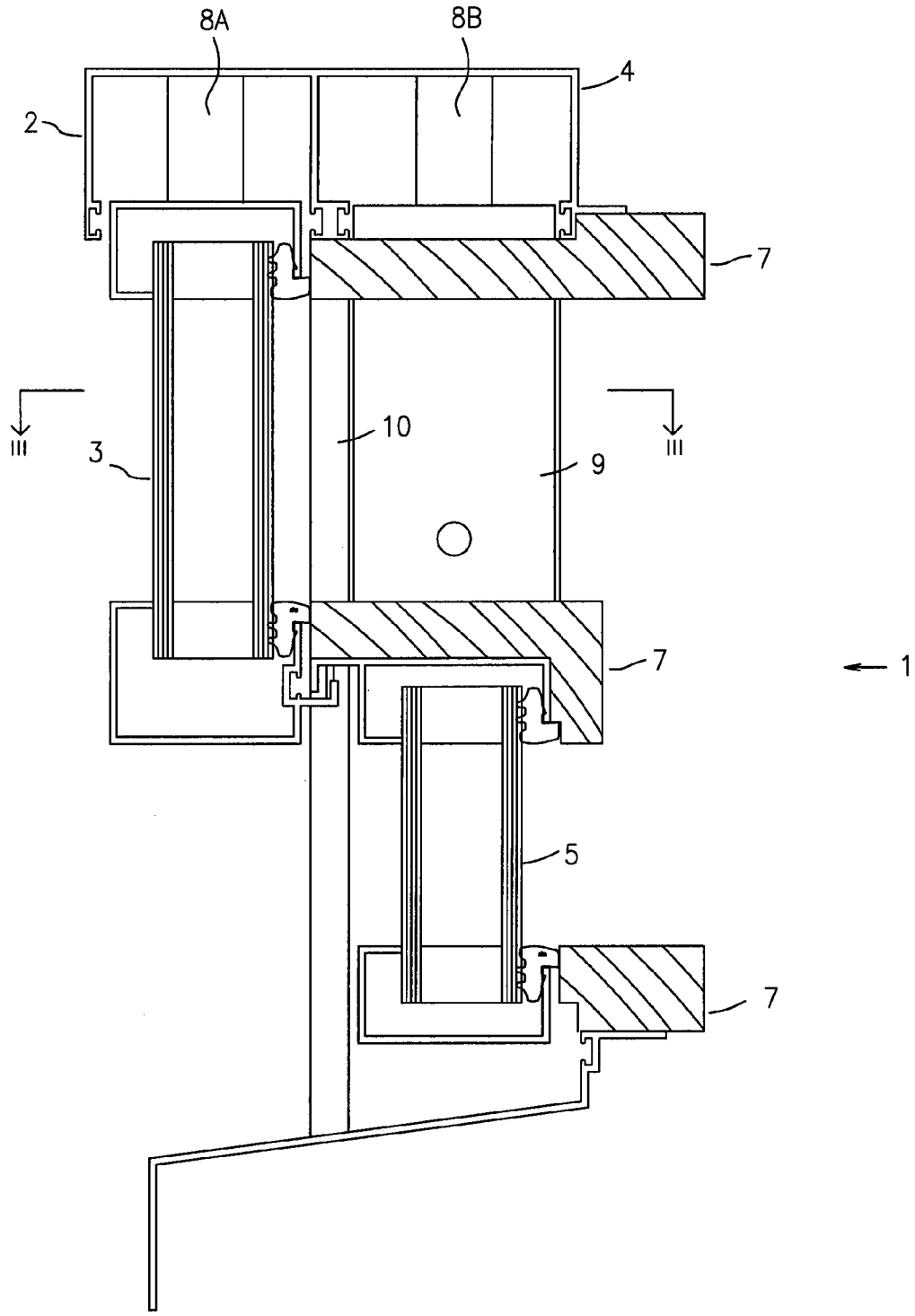
FIG. 2 illustrates a side cross section view of a fenestration assembly with associated panels provided in accordance with a preferred embodiment.

FIG. 2 illustrates a side cross section view of a fenestration assembly with associated panels provided in accordance with a preferred embodiment.

FIGS. 2 through 5 illustrate a fenestration assembly which implements a double hung sliding window in accordance with an alternative embodiment where the fenestration sections are formed in one material such as aluminium and clad in another. The fenestration assembly (1) includes an exterior panel section (2) adapted to receive an exterior panel (3). The fenestration assembly (1) also includes an interior panel section (4) adapted to receive an interior panel (5).

Figure 3:
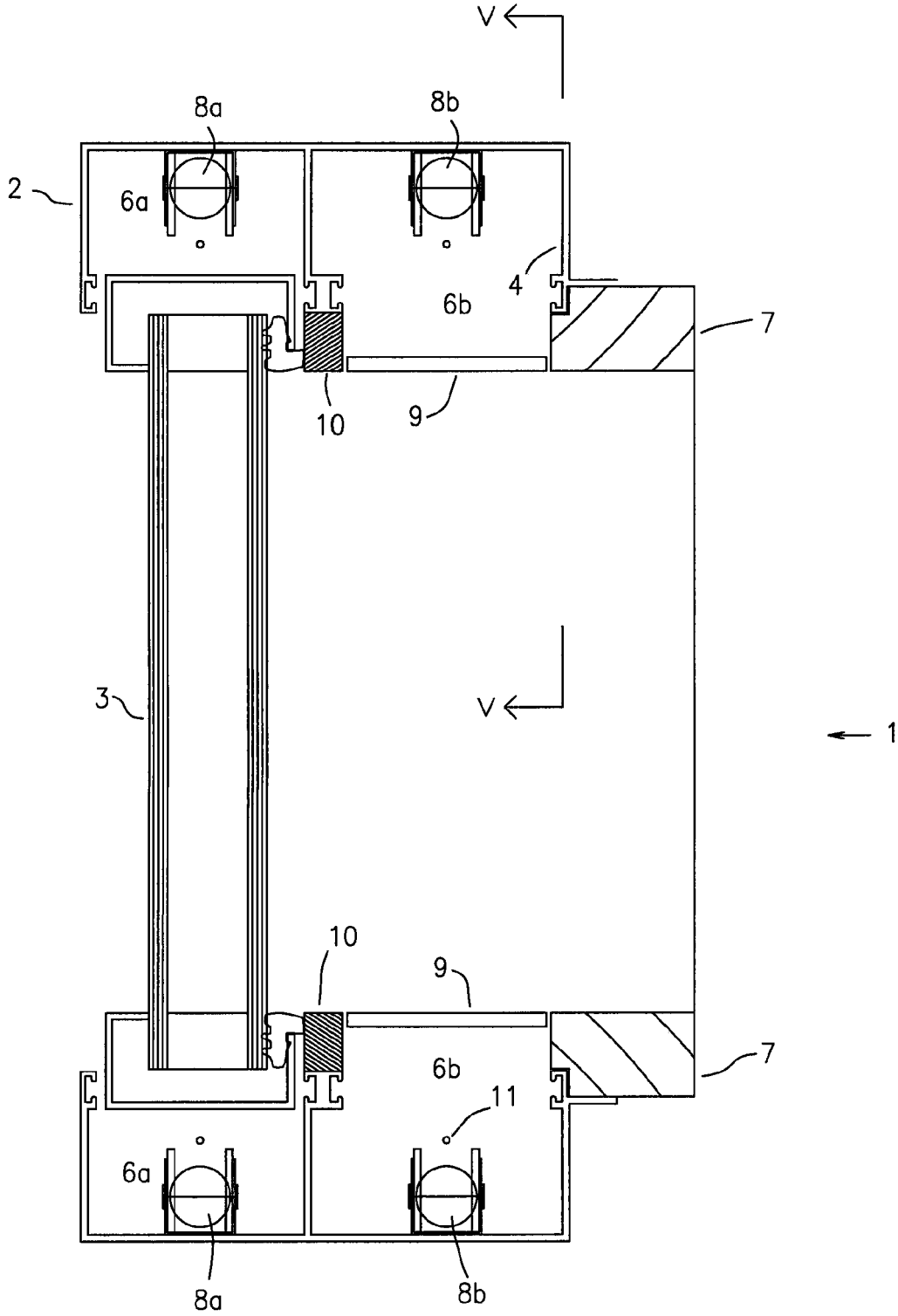
FIG. 3 shows a cross section plan view of the fenestration assembly taken along line III-III of FIG. 2.
Figure 4:
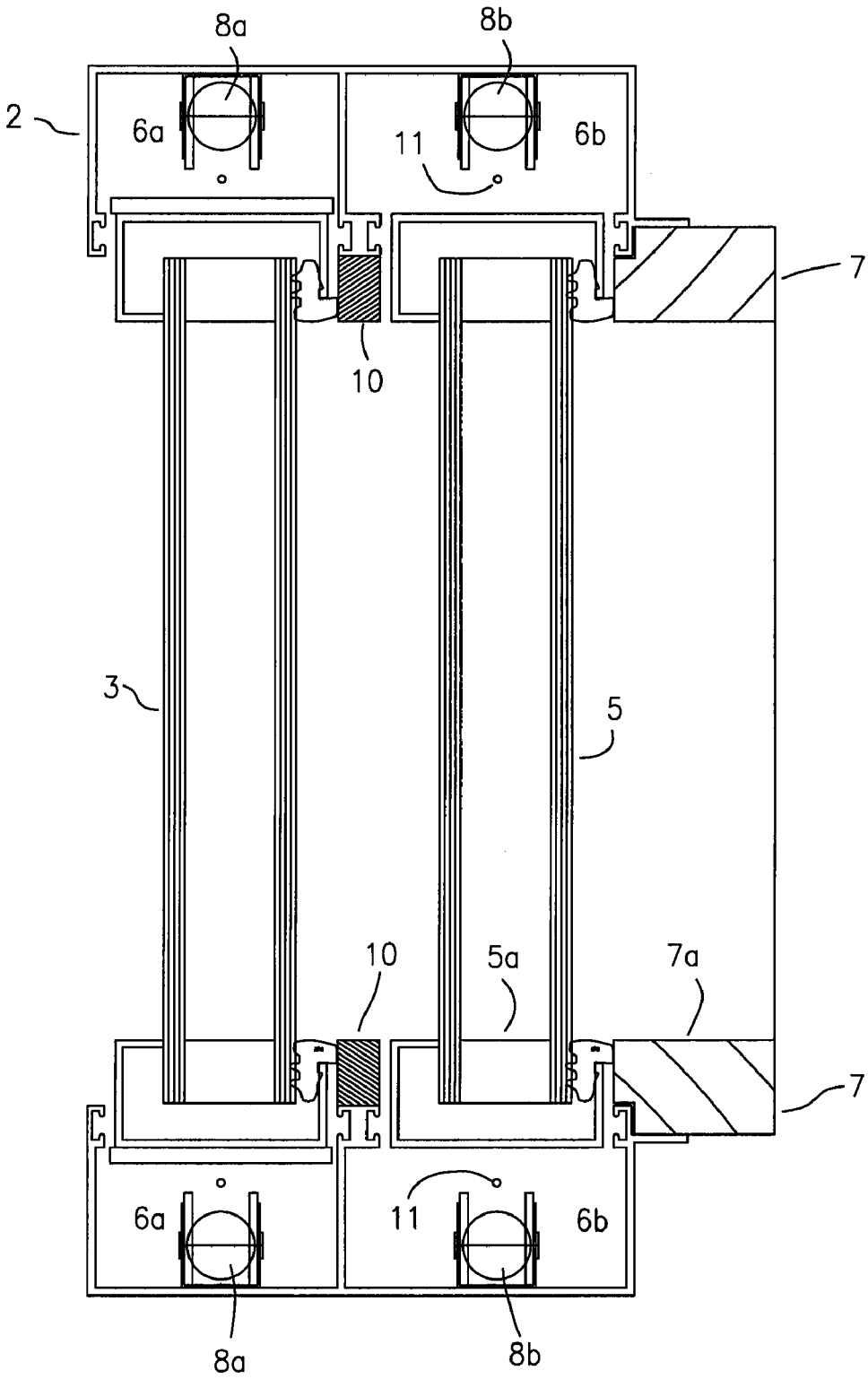
FIG. 4 shows a further cross section plan view of the fenestration assembly taken along line III-III of FIG. 2 when the interior panel(s) provided is placed in an open configuration.

As can be seen from the following FIGS. 3 and 4 each of the interior and exterior panel sections are adapted to define and provide a track (6*a* and 6*b*) which allows each panel (3, 5) to move up and down within the fenestration assembly (1). Both of the exterior and interior panels can slide up and down within these tracks to open or close the resulting window as required by a user. In particular FIGS. 2 and 3 illustrate the fenestration assembly (1) when the interior panel is located in the lower regions of its track, whereas the exterior panel is located in the upper regions of its track to close the resulting window. Conversely FIG. 4 illustrates the resulting window in an open configuration where the exterior panel (3) remains in place while the interior panel (5) is raised into the upper regions of its track to leave an aperture within the lower portion of the fenestration assembly.

The exterior panel section and associated exterior panel face towards the exterior of the structure within which the window provided is to be installed, whereas the interior panel section and it associated interior panel face towards the interior of the structure.

When the fenestration assembly is closed exposed surfaces of the interior panel section (4) which face towards the interior of the structure are covered by thermally insulative cladding materials (7, 9, 10). These cladding materials provide a thermal stop or barrier between the interior of the structure and its exterior—thereby reducing heat transfer through the fenestration assembly. In the embodiment shown the cladding material (7) is formed by cladding elements applied directly to the relevant portions of the interior panel section (4). The cladding material (7) also covers the relevant interior facing exposed surfaces of the framing elements of each of the panels (3, 5). The cladding material (10) covers the relevant elements of the interior panel section (4) and the relevant interior surface of the exterior panel.

As can also be seen from FIGS. 3 and 4 the fenestration assembly (1) includes two paired sets of linkage systems (8*a*, 8*b*) provided within the tracks of each section. In the embodiment shown four spring linkage systems are provided where each pair of linkage systems are connected to a panel to linkage system off the force of gravity acting on the panel. These linkage systems are employed to assist a user in moving each panel within the tracks and also act to retain a panel in position when left by a user.

The linkage systems (8*b*) provided within the interior panel section are specifically modified to perform a covering and insulative role, as opposed to those provided in conjunction with the exterior panel section.

In FIGS. 3 and 4, the positioning of the interior panel surfaces and cover belt (9) aligns with cladding surfaces 7*a* and 10. The combined features promote the aesthetic appeal of the resulting fenestration, as to a user the combination of the interior panel surface and the surface of the cover belt appear as one unbroken visual surface.

Figure 5:
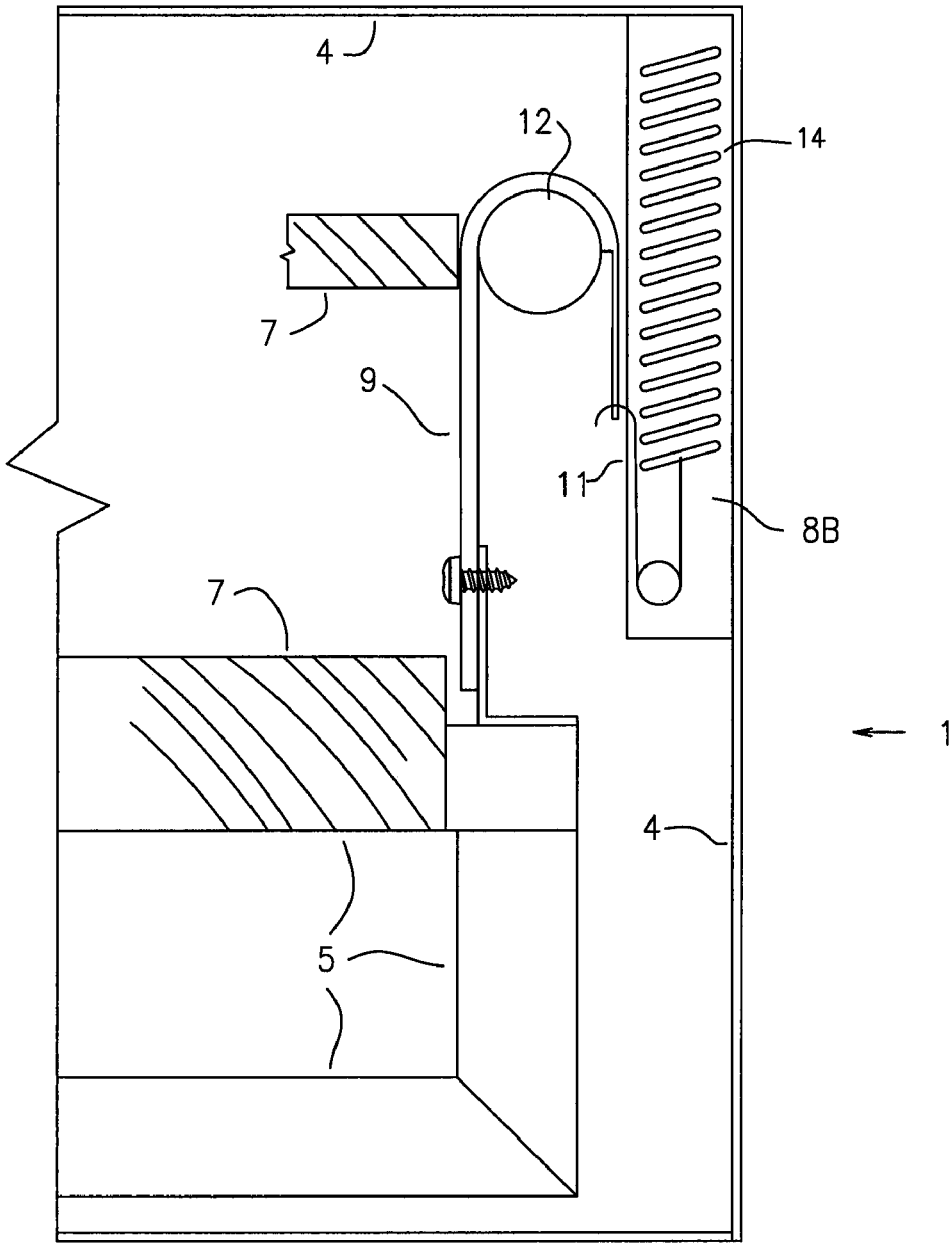
FIG. 5 shows a cross section elevation view of the fenestration assembly of FIG. 2 taken along the line V-V of FIG. 3.

As illustrated in FIG. 5 each of the interior sections' linkage systems (8*b*) include a two part connection to the cover belt from an initial connection cord (11) connected to an extension spring (14). A cover belt (9) is positioned in the interior (6*b*) track by a roller (12) and the cover belt (9) is connected to the upper regions of the interior panel (5). As can be seen from FIG. 3 the cover belt (9) is adapted to cover and encapsulate the interior track cavity (6*b*) provided within the interior panel section.

As illustrated by FIG. 3 an observer of the fenestration assembly (1) on the interior side of the structure will not be able to observe the interior portions of the interior panel section track thereby promoting the aesthetic appeal of the resulting fenestration.

Figure 6:
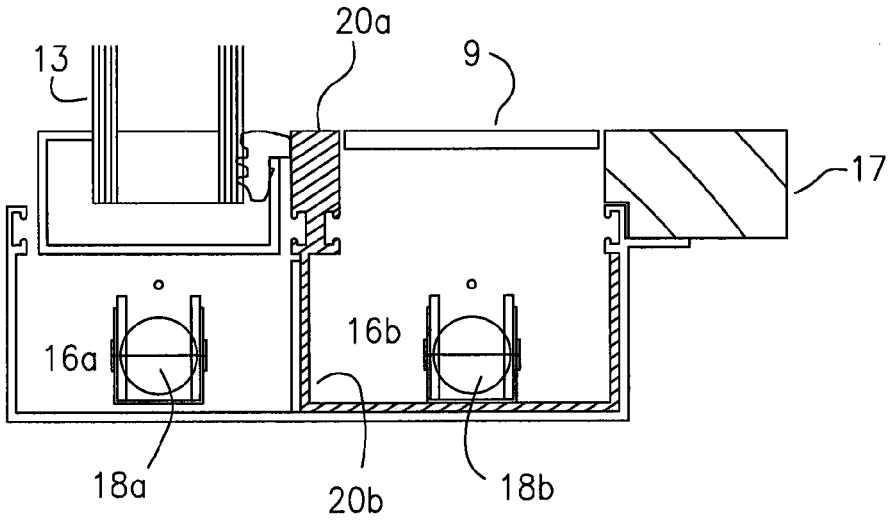
FIG. 6 shows a cross section plan view similar to FIG. 3 and configured in accordance with an alternative embodiment with that discussed with respect to FIGS. 2 through 5.

FIG. 6 shows a cross section plan view of a portion of an interior panel section configured in accordance with an alternative embodiment with that discussed with respect to FIGS. 2 through 5.

As can be seen from FIG. 6 the fenestration section shown includes a similar set of components of that discussed within the embodiment illustrated in FIGS. 2 through 5. An exterior panel (13) is located by one of the pair of tracks (16) which also locates a set of linkage systems (18*a*, 18*b*). On the interior side of the fenestration assembly, wooden cladding material (17) covers the exposed faces of the interior panel section and the interior panel within which the fenestration is to be installed. Furthermore a cover belt (9) is provided to enclose the interior panel section's track (16*b*).

However, in the embodiment shown with respect to FIG. 6 additional thermally insulative cladding material (20) is disposed between the interior panel, and also along the perimeter of the interior track (16*b*) defined within the upper region of the interior panel section. This additional cladding material (20*a*, 20*b*) act to bolster or improve the thermal insulative properties of the cover belt (9) by also cladding and insulating the exposed interior surfaces of the upper regions of the interior track (16*b*). Those skilled in the art should also appreciate such cladding may also extend the entire length of the interior panel section in other embodiments if required.

Aspects of the present invention have been described by way of example only and it should be appreciated that modifications and additions may be made thereto without departing from the scope thereof as defined in the appended claims.

I claim:

1. A fenestration assembly which includes:

an exterior panel section;

an exterior panel located within the exterior panel section;

an interior panel section having an interior track having a generally "U" shaped cross-section with an open top, a pair of side walls and a bottom defining an elongate cavity;

an interior panel located within the interior track of the interior panel section; and a cover belt, connected to the interior panel received by the interior track, in a position generally aligned with the interior track open top and substantially spanning the open top with the cover belt generally aligned with cladding surfaces of the side walls to substantially conceal the side walls and base of the interior track elongate cavity, the cover belt transferring a biasing force to the interior panel.

2. A fenestration assembly as claimed in claim 1, further comprising:

biasing means configured to resist the force of gravity acting on the interior panel and provide the biasing force when the interior panel is raised along the interior track provided within the interior panel section, and the cover belt configured to connect the interior panel to the biasing means and to transfer the biasing force applied by the biasing means to the interior panel, wherein the cover belt is configured to cover the interior track formed within the interior panel section.

3. A fenestration assembly as claimed in claim 1, wherein the interior track within the interior panel section is provided to guide the motion of the interior panel within the interior panel section.

4. A fenestration assembly as claimed in claim 1, wherein the exterior panel section includes an exterior track provided to guide the motion of the exterior panel within the exterior panel section.

5. A fenestration assembly as claimed in claim 1 provided as a double hung window assembly, said assembly being adapted to facilitate vertical movement of both the interior and exterior panels vertically.

6. A fenestration assembly as claimed in claim 1, wherein a second cover belt is connected to the interior panel.

7. A fenestration assembly as claimed in claim 2, wherein the biasing means is formed by an extension spring.

8. A fenestration assembly as claimed in claim 2, wherein the biasing means includes a pulley over which the cover belt runs.

9. A fenestration assembly as claimed in claim 2, wherein the cover belt covers the upper regions of the interior track which are normally exposed when the interior panel is located in the lower regions of the interior panel section.

10. A fenestration assembly as claimed in claim 2, wherein the cover belt is formed from a thermally insulative material.

11. A fenestration assembly as claimed in claim 2, wherein the cover belt is connected to a connection cord.

12. A fenestration assembly as claimed in claim 11, wherein the connection cord is connected to the linkage system's biasing means.

13. A fenestration assembly as claimed in claim 1, wherein the cover belt fills the open top of the interior track.

14. A fenestration assembly as claimed in claim 1 provided as a single hung window assembly, said assembly being adapted to facilitate vertical movement of the interior panel vertically.

* * * * *